US009229425B2

(12) United States Patent
Wakimoto

(10) Patent No.: US 9,229,425 B2
(45) Date of Patent: Jan. 5, 2016

(54) IMAGE FORMING APPARATUS WITH DETACHABLE REPLACEMENT MEMBER

(71) Applicant: KYOCERA Document Solutions Inc., Osaka-shi, Osaka (JP)

(72) Inventor: Atsuhiro Wakimoto, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/603,240

(22) Filed: Jan. 22, 2015

(65) Prior Publication Data

US 2015/0212482 A1 Jul. 30, 2015

(30) Foreign Application Priority Data

Jan. 24, 2014 (JP) ..... 2014-011489

(51) Int. Cl.

| | |
|---|---|
| ***G03G 15/08*** | (2006.01) |
| ***G03G 21/18*** | (2006.01) |
| ***G03G 21/16*** | (2006.01) |
| ***G03G 15/00*** | (2006.01) |

(52) U.S. Cl.

CPC ..... *G03G 21/1839* (2013.01); *G03G 15/0863* (2013.01); *G03G 15/80* (2013.01); *G03G 21/1676* (2013.01); *G03G 21/1867* (2013.01); *G03G 2221/166* (2013.01)

(58) Field of Classification Search

CPC ..... G03G 21/1839; G03G 21/1676; G03G 21/1842; G03G 21/1867; G03G 21/1871; G03G 15/0863; G03G 15/80; G03G 2221/1647; G03G 2221/166

USPC ..... 399/90, 110, 111, 119, 120, 262

See application file for complete search history.

(56) References Cited

U.S. PATENT DOCUMENTS

| | | | | |
|---|---|---|---|---|
| 8,478,162 | B2 * | 7/2013 | Arasawa | 399/111 |
| 8,660,453 | B2 * | 2/2014 | Oda et al. | 399/90 |
| 2008/0292356 | A1 * | 11/2008 | Furuichi et al. | 399/110 X |
| 2010/0166466 | A1 * | 7/2010 | Sato | 399/262 |
| 2012/0039622 | A1 * | 2/2012 | Cho | 399/90 |
| 2013/0343777 | A1 * | 12/2013 | Amann et al. | 399/90 |

FOREIGN PATENT DOCUMENTS

JP 2012234190 A 11/2012

* cited by examiner

*Primary Examiner* — Sophia S Chen

(74) *Attorney, Agent, or Firm* — Alleman Hall McCoy Russell & Tuttle LLP

(57) ABSTRACT

Image forming apparatus including: attachment portion which is provided in apparatus main body and in which support plates are disposed to face each other; and replacement member which is supported between support plates of attachment portion in attachable/detachable manner. Replacement member includes first contact portion which is provided on side surface that faces one support plate and is electrically conductive when contacted with one support plate. Attachment portion includes second contact portion and support portion. Second contact portion is provided on one support plate and is electrically connected with first contact portion upon contact with it. Support portion, during attachment operation in which replacement member is attached to attachment portion, is engaged with replacement member and allows first contact portion to be moved to predetermined set position at which first contact portion is in contact with second contact portion.

8 Claims, 9 Drawing Sheets

IMAGE FORMING APPARATUS WITH DETACHABLE REPLACEMENT MEMBER

INCORPORATION BY REFERENCE

This application is based upon and claims the benefit of priority from the corresponding Japanese Patent Application No. 2014-011489 filed on Jan. 24, 2014, the entire contents of which are incorporated herein by reference.

BACKGROUND

The present disclosure relates to an image forming apparatus which includes a replacement member such as a toner container that is supported by an attachment portion in an attachable/detachable manner, and in which a first contact portion of the replacement member contacts a second contact portion of the attachment portion during attachment of the replacement member.

There has been known an image forming apparatus, such as a copier or a printer, that forms an image on a print sheet based on the electrophotography. The image forming apparatus includes a developing device. The developing device stores, in the inside thereof, developer that contains toner. The developing device develops an electrostatic latent image formed on an image carrier such as a photoconductor drum, by the toner contained in the developer. The toner inside the developing device is decreased as the developing device performs the developing. As a result, the image forming apparatus is configured to include a toner container (replacement member) in which toner is stored so that the toner is supplied from the toner container to the developing device. In addition, the toner container is configured to be attachable/detachable with respect to the image forming apparatus. When the toner in the toner container is used up, the toner container is replaced with a new toner container filled with toner.

On the surface of the toner container of this type, a storage portion called memory chip is attached, wherein the storage portion stores information including information related to the toner container and the toner. When the toner container is attached to the image forming apparatus, connection terminals of the storage portion are electrically contacted with connection terminals of a reading portion provided in the image forming apparatus. This allows the information stored in the storage portion to be read by the reading portion.

Meanwhile, parts of the image forming apparatus may not be formed according to the designed size and may have a size tolerance. In addition, the parts may vary in size by expanding or shrinking depending on the environment (humidity, temperature, etc.) in which the image forming apparatus is installed. As a result, in the image forming apparatus, the toner container and the attachment portion to which the toner container is attached may vary in size. Such variation in size may cause a contact failure between the contact terminals of the reading portion and the storage portion in the state where the toner container has been attached to the attachment portion.

SUMMARY

An image forming apparatus according to an aspect of the present disclosure includes an attachment portion and a replacement member. The attachment portion is provided in an apparatus main body, and in the attachment portion, support plates are disposed to face each other. The replacement member is supported between the support plates of the attachment portion in an attachable/detachable manner. The replacement member includes a first contact portion which is provided on a side surface that faces one of the support plates and is electrically conductive when contacted with the one of the support plates. The attachment portion includes a second contact portion and a support portion. The second contact portion is provided on the one of the support plates and is electrically connected with the first contact portion upon contact therewith. The support portion, during an attachment operation in which the replacement member is attached to the attachment portion, is engaged with the replacement member and allows the first contact portion to be moved to a predetermined set position at which the first contact portion is in contact with the second contact portion.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
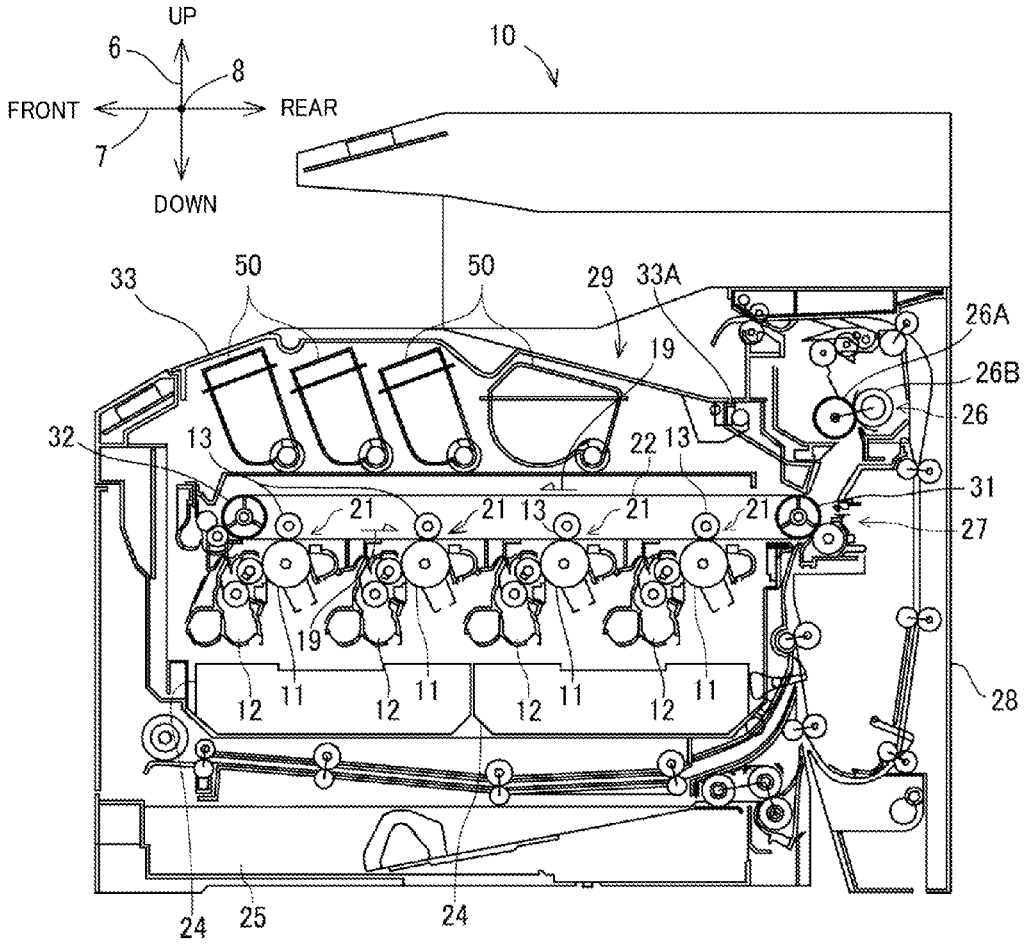
FIG. 1 is a diagram showing the configuration of an image forming apparatus according to an embodiment of the present disclosure.

The following describes an image forming apparatus 10 in an embodiment of the present disclosure with reference to the drawings. It is noted that for the sake of explanation, an up-down direction 6 is defined based on the state (the state shown in FIG. 1) where the image forming apparatus 10 is installed on a flat surface. In addition, a front-rear direction 7 is defined on the supposition that the left side on the paper surface of FIG. 1 is the front side of the image forming apparatus 10. Furthermore, a left-right direction 8 (a direction perpendicular to the paper surface of FIG. 1) is defined based on the image forming apparatus 10 shown in FIG. 1 viewed from the front side.

[Configuration of Image Forming Apparatus 10]

The image forming apparatus 10 includes at least a print function. As shown in FIG. 1, the image forming apparatus 10 is a so-called tandem color printer. The image forming apparatus 10 prints an image on a sheet of print paper (recording medium) by using a developer that contains toner. It is noted that the image forming apparatus 10 may be any apparatus as far as it has the print function. For example, the image forming apparatus 10 may be a multifunction peripheral having a plurality of functions including the print function, or may be a FAX apparatus, a copier or the like. Of course, the image forming apparatus 10 may be an apparatus that forms a monochrome image, instead of an apparatus that forms a color image.

As shown in FIG. 1, the image forming apparatus 10 includes, as major components, four image forming portions 21, an intermediate transfer belt 22, a sheet feed device 25, a fixing device 26, a secondary transfer device 27, an exposure device 24, and four toner containers 50 (50A-50D). These components are attached to a housing 28 (an example of the apparatus main body of the present disclosure) that forms at least an external frame (not shown) and an internal frame (not shown) of the image forming apparatus 10. It is noted that the toner containers 50 are an example of the replacement member in the image forming apparatus 10.

The four image forming portions 21 are disposed in an alignment along the front-rear direction 7 in the housing 28. The image forming portions 21 form toner images respectively on the photoconductor drums 11, and transfer the toner images to the intermediate transfer belt 22 such that the toner images are overlaid on the intermediate transfer belt 22 that is moving in a direction indicated by the arrow 19. In an example shown in FIG. 1, in order from the downstream side in the movement direction (the direction indicated by the arrow 19) of the intermediate transfer belt 22, the image forming portions 21 for black, yellow, cyan, and magenta are disposed in a row.

The image forming portions 21 execute an image forming process of forming an image on a print sheet based on the so-called electrophotography. The image forming portions 21 print an image on a print sheet based on the image data input from outside via a network communication portion (not shown). Each of the image forming portions 21 includes a photoconductor drum 11, a charging device (not shown), a developing device 12, a primary transfer device 13, and the like. The photoconductor drum 11 carries a toner image on its surface. The charging device charges the surface of the corresponding photoconductor drum 11 to a certain potential. The exposure device 24 scans the charged photoconductor drum 11 with laser light based on the image data. This allows an electrostatic latent image to be written on the surface of the photoconductor drum 11. Subsequently, the developing device 12 causes toner to be adhered to the electrostatic latent image on the photoconductor drum 11, thereby developing the electrostatic latent image with the toner. The primary transfer device 13 transfers the toner image on the rotating photoconductor drum 11 to the intermediate transfer belt 22. It is noted that although not shown in FIG. 1, each image forming portion 21 includes a cleaning device that removes the toner image that has remained on the photoconductor drum 11.

The intermediate transfer belt 22 is disposed above the image forming portions 21. The intermediate transfer belt 22 is a belt having a shape of an endless loop and is made of rubber, urethane or other material. The intermediate transfer belt 22 is supported and rotationally driven by a driving pulley 31 and a driven pulley 32. This allows a belt surface to extend horizontally in the front-rear direction 7. The driving pulley 31 is disposed at a rear position close to the fixing device 26 (on the right side in FIG. 1). The driven pulley 32 is disposed at a front position away from the fixing device 26 (on the left side in FIG. 1). By being supported by the driving pulley 31 and the driven pulley 32, the intermediate transfer belt 22 can be moved (run) with its surface contacting the surfaces of the photoconductor drums 11. When the intermediate transfer belt 22 passes between the photoconductor drums 11 and the primary transfer devices 13, the toner images are transferred in sequence from the photoconductor drums 11 onto the surface of the intermediate transfer belt 22 so as to be overlaid with each other.

The secondary transfer device 27 is disposed in the rear of the housing 28. The secondary transfer device 27 transfers the toner images of the plurality of colors from the intermediate transfer belt 22 to a print sheet conveyed from a sheet feed tray of the sheet feed device 25. The print sheet with the toner images thus transferred is conveyed to the fixing device 26. The fixing device 26 fixes the toner images on the print sheet, to the print sheet by heat. The fixing device 26 includes a heating roller 26A and a pressure roller 26B. The heating roller 26A is heated to a high temperature. The pressure roller 26B is arranged to face the heating roller 26A. The print sheet conveyed to the fixing device 26 is conveyed while being nipped by a predetermined biasing force at a nip portion between the heating roller 26A and the pressure roller 26B. This allows the toner images to be fixed to the print sheet. Subsequently, the print sheet is discharged onto a discharge tray 29 provided on an upper part of the housing 28.

As described above, the image forming apparatus 10 forms a color toner image on the surface of the intermediate transfer belt 22 by causing the plurality of image forming portions 21 to transfer toner images of different colors onto the intermediate transfer belt 22 while the belt is running so that the color toner images are overlaid with each other. The secondary transfer device 27 transfers the color toner image from the intermediate transfer belt 22 to a print sheet. This allows a color image to be formed on the print sheet. Note that, as another embodiment, the intermediate transfer belt 22 may be used as a conveyance belt, and the toner images may be overlaid directly on a print sheet that is conveyed on the conveyance belt. Also, as a still another embodiment, an intermediate transfer member shaped like a roller may be used in place of the intermediate transfer belt 22.

Figure 2A:
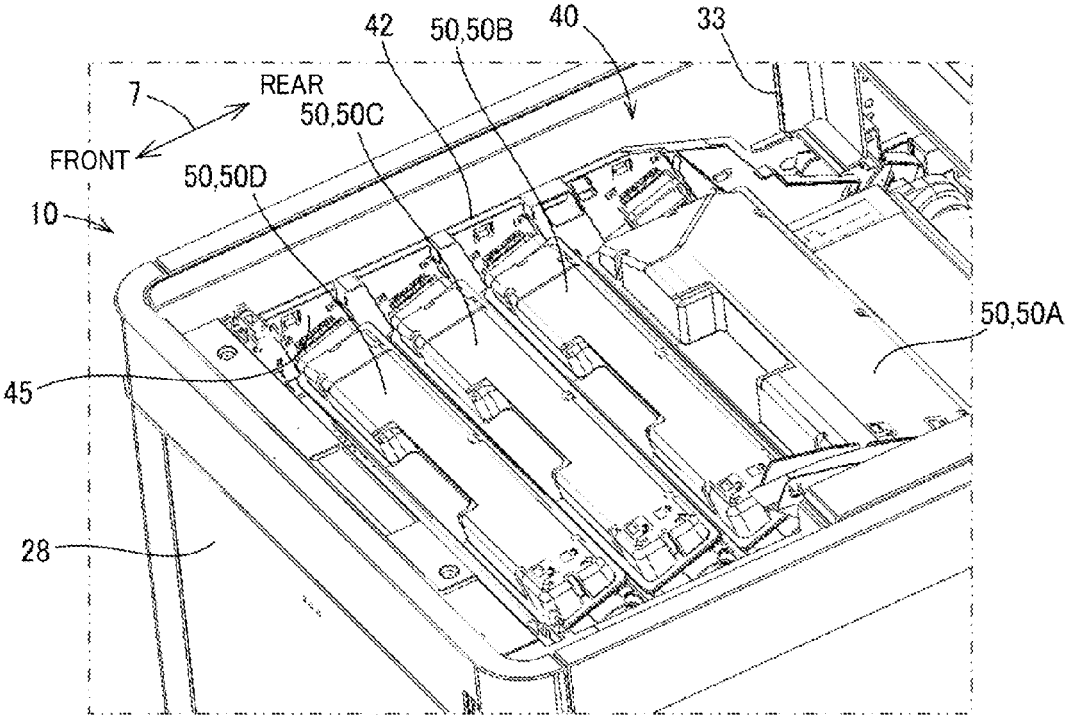
FIG. 2A is a diagram showing an attachment state of toner containers to the image forming apparatus.
Figure 2B:
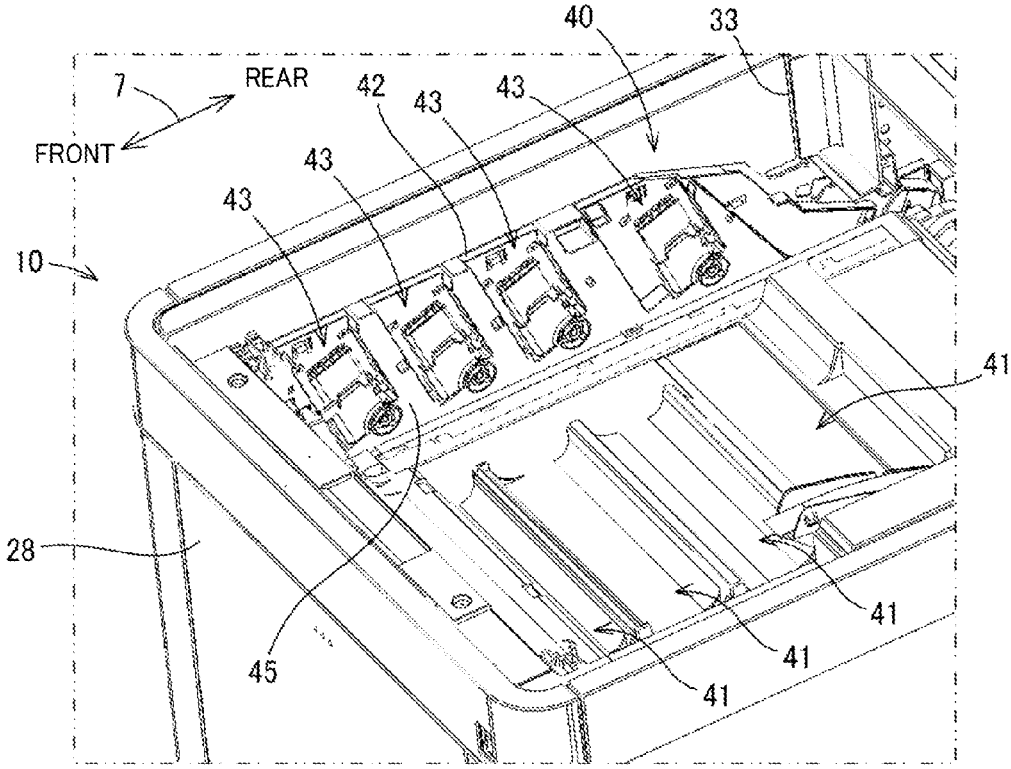
FIG. 2B is a diagram showing an attachment portion of the image forming apparatus to which the toner containers are attached.

The four toner containers 50 (50A-50D) are disposed above the intermediate transfer belt 22. Inside the housing 28, the four toner containers 50 are aligned in a row along the intermediate transfer belt 22 in the front-rear direction 7. The toner containers 50 are configured to supply toner respectively to developing devices 12 of corresponding colors. As shown in FIGS. 2A and 2B, the toner containers 50 are attached to an attachment portion 40 that is provided in the housing 28. In the present embodiment, a top cover 33 is provided on an upper part of the housing 28. The top cover 33 is supported by the housing 28 such that the top cover 33 can be opened and closed rotationally around the spindle 33A. When the top cover 33 is rotationally moved upward (in the opening direction), the attachment portion 40, to which the toner containers 50 are attached, is exposed. When attached to the attachment portion 40, the toner containers 50 are held respectively in four housing spaces 41 formed in the attachment portion 40.

The toner containers 50 store toner of different colors that correspond to the colors of the image forming portions 21. Specifically, the toner containers 50 (50A-50D) store toner of black, yellow, cyan, and magenta, respectively. As shown in FIGS. 2A and 2B, among the four toner containers 50, the toner container 50A positioned on the most rear side is a large-capacity type and can store larger amount of toner than the other toner containers 50B-50D. The toner container 50A stores black toner. The toner containers 50B-50D have the same shape and capacity. The toner container 50B stores yellow toner, the toner container 50C stores cyan toner, and the toner container 50D stores magenta toner.

[Configuration of Toner Containers 50]

The following describes the configuration of the toner containers 50. It is noted here that the large-capacity-type toner container 50A and the other toner containers 50B-50D have the same configuration except for the size of the toner storing part. As a result, in the following description, the toner containers 50B-50D are described as a toner container 50.

The toner container 50 supplies toner to the developing device 12. The toner container 50 is configured to be attachable/detachable with respect to the attachment portion 40 (see FIGS. 2A and 2B) provided in the housing 28, and is an example of the replacement member. The toner container 50 is inserted from an upper opening of the housing 28 and held in a corresponding housing space 41 in the attachment portion 40.

Figure 3:
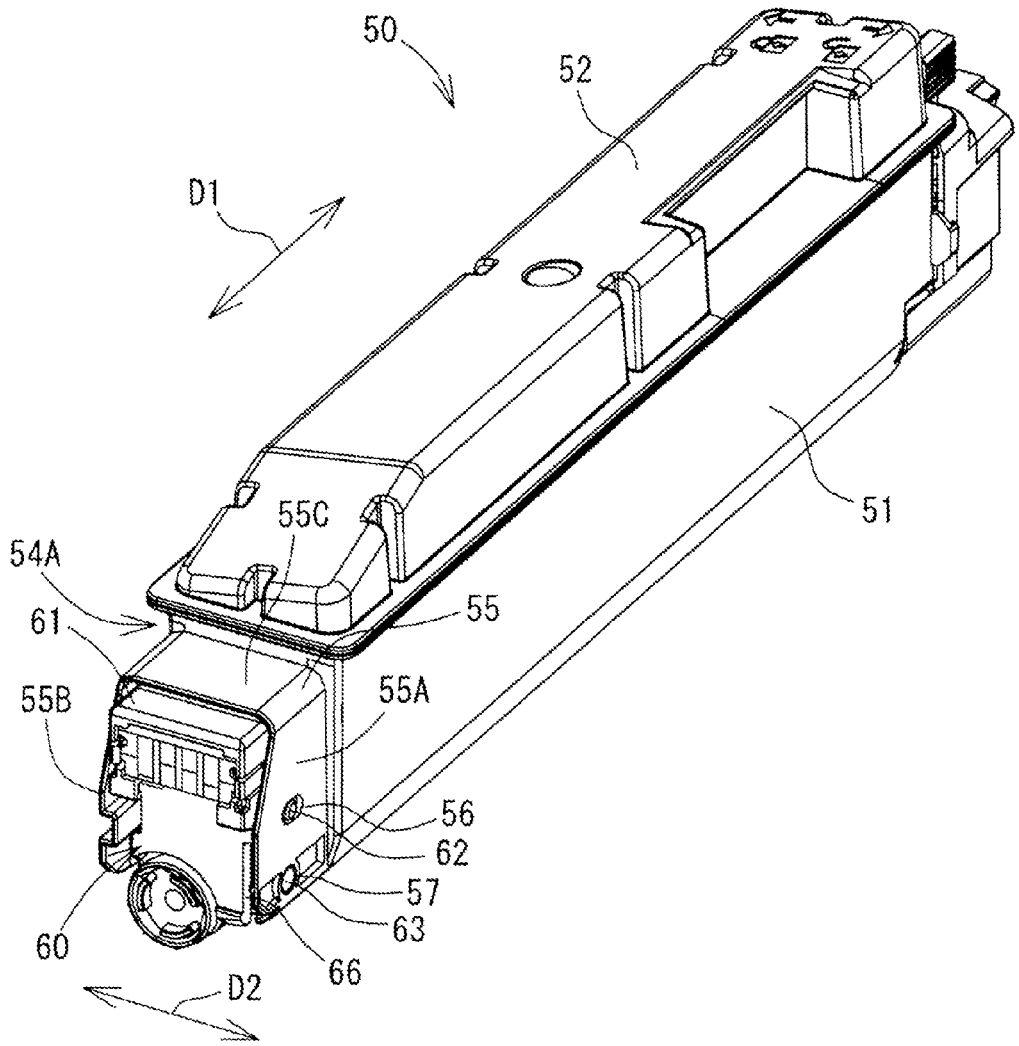
FIG. 3 is a diagram showing the configuration of the toner container.

As shown in FIG. 3, the toner container 50 includes a housing 51, a lid 52, and a memory holder 60 (an example of the holding portion of the present disclosure).

The housing 51 is a storing part for storing toner, and is formed in the shape of a box elongated in one direction. The housing 51 has an opening at the upper part thereof, and the lid 52 is provided to close the opening. The toner to be used in the developing process by the developing device 12 is stored in an inner space defined by the housing 51 and the lid 52. The housing 51 and the lid 52 are synthetic resin products formed by the injection molding in which a mold is filled with melted synthetic resin, and then the resin is hardened. As the material of the housing 51 and the lid 52, a thermoplastic synthetic resin may be used. Specifically, the ABS (acrylonitrile-butadiene-styrene) resin, the PET (polyethylene terephthalate) resin, or a synthetic resin composed mainly of these may be used as the material of the housing 51 and the lid 52.

The memory holder 60 is attached to a side surface 54A of the housing 51 that is at one side of the housing 51 in a longitudinal direction D1. Specifically, a protruding portion 55 is integrally formed with the side surface 54A, and the memory holder 60 is attached to the protruding portion 55.

The protruding portion 55 is formed in the shape of a curved rectangular plate, projecting outside in the longitudinal direction D1. The protruding portion 55 includes side walls 55A and 55B positioned at opposite ends in a short direction D2, and an upper wall 55C that connects upper ends of the side walls 55A and 55B. The side walls 55A and 55B are parallel to each other, and the outer side surfaces thereof are formed flat. The memory holder 60 is attached to the inside of the protruding portion 55 surrounded by the upper wall 55C and side walls 55A and 55B. It is noted that the attachment configuration of the memory holder 60 is described below.

When the toner container 50 is attached to the attachment portion 40, the protruding portion 55 is inserted into a guide groove 70 (see FIGS. 6A and 6B) provided in the attachment portion 40, and the guide groove 70 guides the toner container 50 in the attachment/detachment direction of the toner container 50. At this time, the side walls 55A and 55B of the protruding portion 55 abut on the guide groove 70, and are guided in a guide direction (the same direction as the attachment/detachment direction of the toner container 50) by the guide groove 70. That is, the protruding portion 55 serves as a guide member that guides the toner container 50 in the attachment/detachment direction with respect to the attachment portion 40.

Elongated holes 56 that are elongated in the longitudinal direction D1 are respectively formed in the side walls 55A and 55B at approximately the center thereof. The elongated hole 56 on the side wall 55B side is not shown in FIG. 3 because it is hidden by other member. The elongated holes 56 play a role of guiding guide shafts 62 of the memory holder 60 in the longitudinal direction such that the memory holder 60 is moved toward and away from the side surface 54A, wherein the guide shafts 62 are described below. In addition, shaft holes 57 are respectively formed in the side walls 55A and 55B at a position below the elongated holes 56 and near the lower end thereof. The shaft holes 57 axially support pivoting shafts 63 of the memory holder 60 in a state where the pivoting shafts 63 are inserted therein, the pivoting shafts 63 being described below.

Figure 4B:
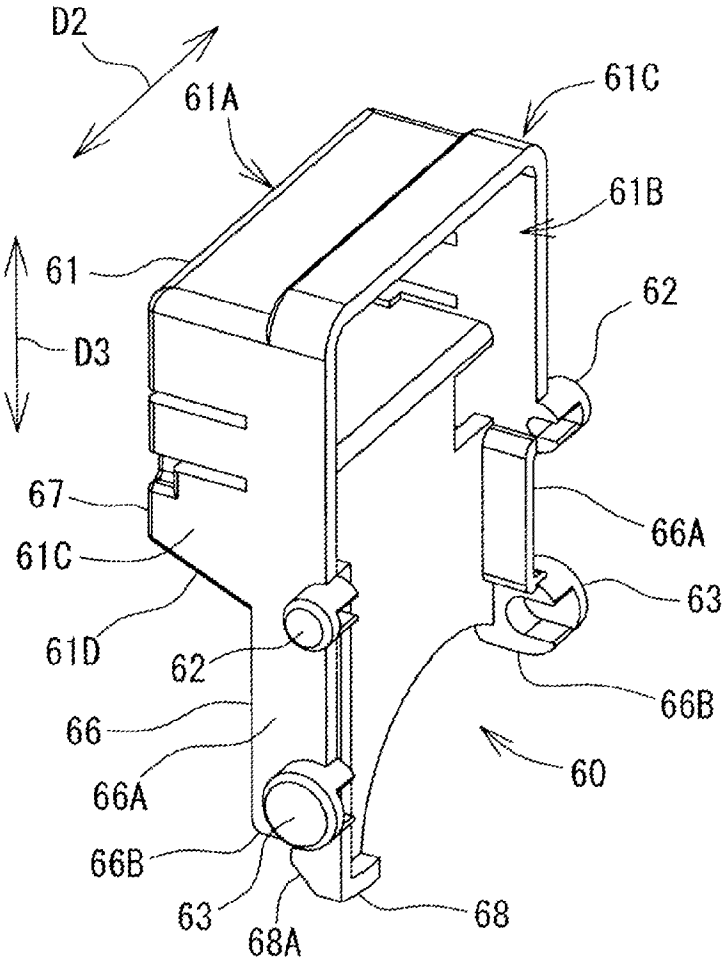
FIGS. 4A and 4B are diagrams showing a memory holder included in the toner container.
Figure 4A:
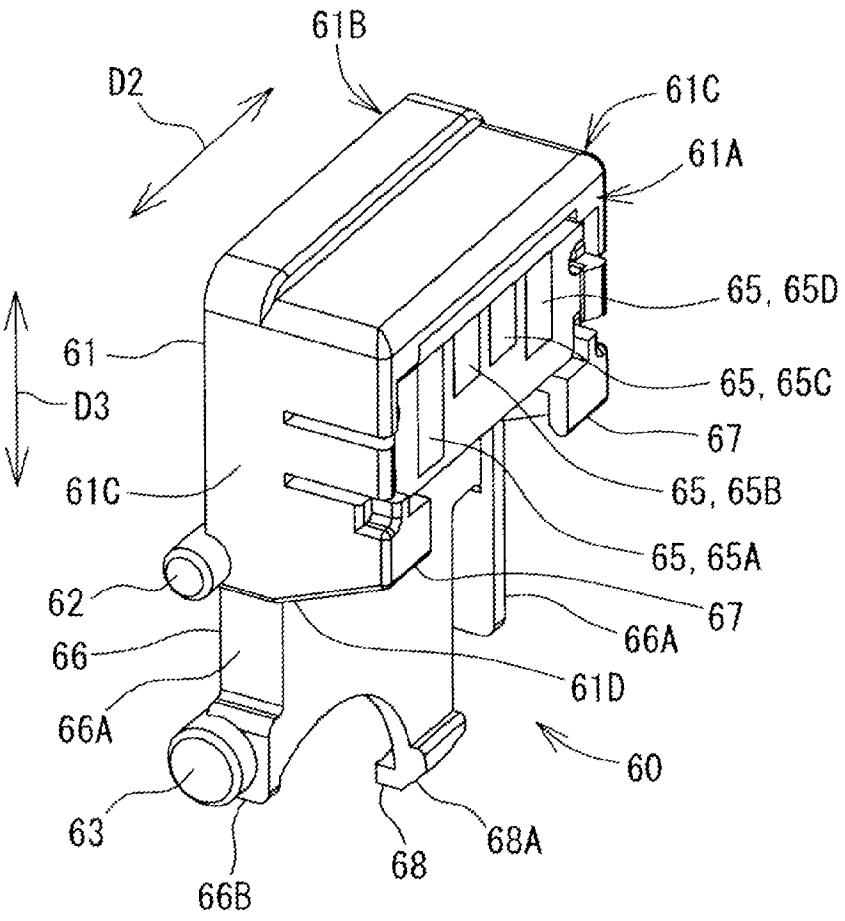
Figure 5:
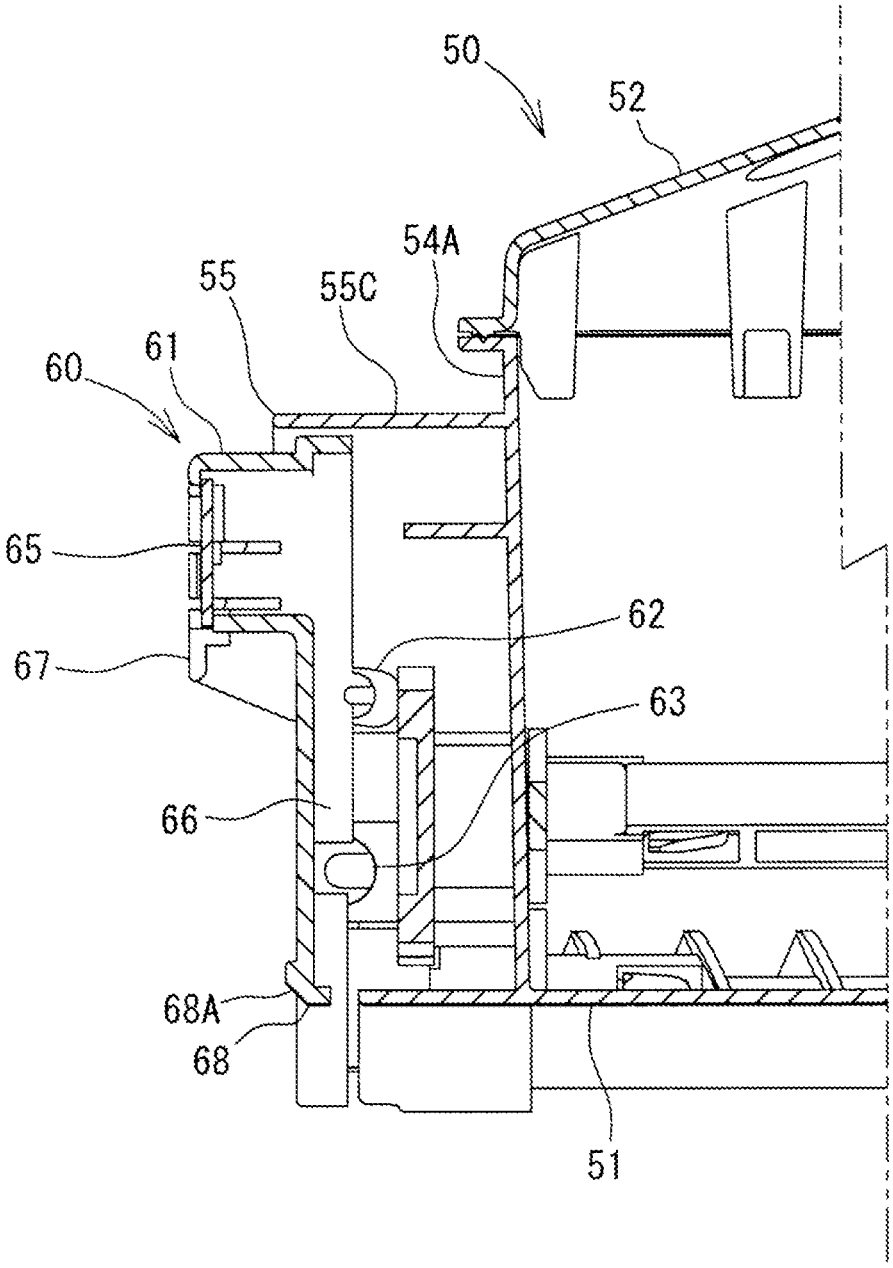
FIG. 5 is a sectional view of a protruding portion shown in FIG. 3.

As shown in FIGS. 4A and 4B, the memory holder 60 includes a holder main body 61, the guide shafts 62, and the pivoting shafts 63. The holder main body 61 is partially housed in the protruding portion 55. The guide shafts 62 are inserted into the elongated holes 56 of the protruding portion 55. The pivoting shafts 63 are pivotably supported by the shaft holes 57 of the protruding portion 55. The memory holder 60 is a synthetic resin product that is formed from synthetic resin by the injection molding. As a result, the holder main body 61, guide shafts 62, and pivoting shafts 63 are integrally formed.

The holder main body 61 has a shape of a rectangular parallelepiped whose inside is hollow. A rear surface 61B of the holder main body 61 is disposed inside the protruding portion 55, and the whole area of the rear surface 61B is opened. The holder main body 61 has a front surface 61A, and connection terminals 65 (65A-65D) of a storage portion (not shown) are provided on the front surface 61A, wherein the storage portion is, for example, a chip memory or a flash memory. These four connection terminals 65 are electrically conducted with a conductive material when they contact the conductive material, and are an example of the first contact portion of the present disclosure. The four connection terminals 65 are disposed in an alignment in a width direction D2 on the front surface 61A. The four connection terminals 65A-65D are, for example, electrodes made from copper foil. The connection terminal 65A is a ground electrode, the connection terminals 65B and 65C are signal electrodes, and the connection terminal 65D is a power source electrode. In the present embodiment, the electrode length of each of the connection terminals 65 is determined such that, when the toner container 50 is attached to the attachment portion 40, the connection terminal 65A first contacts a corresponding connection terminal 73 provided in the attachment portion 40 (see FIG. 6A), then the connection terminal 65D contacts a corresponding connection terminal 73, and finally the connection terminals 65B and 65C respectively contact corresponding connection terminals 73, wherein the connection terminals 73 are described below.

The storage portion stores information related to the toner stored in the toner container 50. The information related to the toner includes, for example, the amount of toner stored in an unused toner container 50, the remaining amount of toner, a time when the toner was stored, and conditions under which the stored toner is applicable. It is noted that the storage portion is fixed to the rear side of the holder main body 61 or to the side surface 54A, and is connected to the connection terminals 65 via a wire harness including a signal line and a power source line.

The guide shafts 62 are provided respectively on opposite side surfaces 61C of the holder main body 61 in the width direction D2. The guide shafts 62 are provided near a lower end 61D of the holder main body 61. The guide shafts 62 are provided near the lower end 61D close to the rear surface 61B. The guide shafts 62 are shafts having a shape of a circle in cross section, and project outside from the side surfaces 61C. The guide shafts 62 are respectively inserted into the elongated holes 56 of the protruding portion 55. It is noted that the length of the projected parts of the guide shafts 62 is determined such that the guide shafts 62 inserted in the elongated holes 56 do not project outside the outer side surfaces of the side walls 55A and 55B of the protruding portion 55.

The memory holder 60 includes an arm 66 that extends downward from the lower end 61D of the holder main body 61. The pivoting shafts 63 are respectively provided on opposite side surfaces 66A of the arm 66 in the width direction D2. The pivoting shafts 63 are provided near a lower end 66B of the arm 66. The pivoting shafts 63 have a shape of a circle in cross section, and respectively project outside from the side surfaces 66A. The pivoting shafts 63 are respectively inserted into the shaft holes 57 of the protruding portion 55. It is noted that the length of the projected parts of the pivoting shafts 63 is determined such that the pivoting shafts 63 axially supported by the shaft holes 57 do not project outside the outer side surfaces of the side walls 55A and 55B of the protruding portion 55.

With the configuration of the memory holder 60 as described above, the memory holder 60 is attached to the protruding portion 55 by inserting the pivoting shafts 63 into the shaft holes 57 for support thereby and inserting the guide shafts 62 into the elongated holes 56. Specifically, the memory holder 60 is supported by the protruding portion 55 so as to be rotationally moved around the pivoting shafts 63. As described above, the protruding portion 55 is provided on the side surface 54A that is at one side of the toner container 50 in the longitudinal direction D1. Therefore, the attachment of the memory holder 60 to the protruding portion 55 means that the connection terminals 65 are provided on the side surface 54A of the toner container 50 via the memory holder 60 and the protruding portion 55. That is, the connection terminals 65 are provided on the side surface 54A of the toner container 50 via the memory holder 60 and the protruding portion 55.

The range of the rotational movement of the memory holder 60 with respect to the protruding portion 55 is determined by setting the length of the elongated holes 56 appropriately. In the present embodiment, the memory holder 60 is supported by the protruding portion 55 so as to be rotationally moved around the pivoting shafts 63 between a first attitude (the attitude shown in FIG. 9A) and a second attitude (the attitude shown in FIG. 9E). Here, in the first attitude, the rear surface 61B side of the holder main body 61 is partially retracted into the protruding portion 55 and the memory holder 60 is closest to the side surface 54A (see FIG. 9A). In the second attitude, the holder main body 61 is pulled out from the protruding portion 55 at maximum and the memory holder 60 is at the largest distance from the side surface 54A (see FIG. 9E). Since the memory holder 60 is pivotably supported in the above-described manner, the memory holder 60 can be dislocated toward and away from the side surface 54A. That is, the memory holder 60 is supported by the protruding portion 55 in such a manner that the memory holder 60 can be moved toward and away from the side surface 54A. When the memory holder 60 takes the second attitude to be at the largest distance from the side surface 54A, the connection terminals 65 are pulled toward connection terminals 73 of the attachment portion 40 and moved to a position (the position shown in FIG. 9E) corresponding to the second attitude, wherein the connection terminals 73 are described below.

Furthermore, the toner container 50 includes two engagement pieces 67 (an example of the pressing portion of the present disclosure). Specifically, as shown in FIGS. 4A and 4B, the engagement pieces 67 are integrally formed with the memory holder 60 which is provided in the toner container 50. The engagement pieces 67 are parts that are to be engaged with an inclined surface 77A of a cover 77 that is described below (see FIG. 8). The engagement pieces 67 are formed on the lower end 61D of the holder main body 61 at the front surface 61A side. In other words, the engagement pieces 67 are provided on the front surface 61A of the holder main body 61 at the lower end thereof. The engagement pieces 67 are respectively provided at opposite ends of the front surface 61A of the holder main body 61 in the width direction D2 at the lower end thereof. The engagement pieces 67 are each formed in the shape of a claw that extends downward from the lower end 61D of the holder main body 61.

The arm 66 of the memory holder 60 includes a projection piece 68 that extends downward to a lower position than the pivoting shafts 63. The projection piece 68 is a part that projects downward from approximately the center of the arm 66 of the memory holder 60 in the width direction D2. The tip (lower end) of the projection piece 68 has an inclined surface 68A that is inclined with respect to a height direction D3 of the memory holder 60. The inclined surface 68A is formed on the front surface 61A side of the holder main body 61, and is inclined at approximately 45 degrees with respect to the height direction D3. The inclined surface 68A is a part that abuts on an upper end 80A of a storing portion 80 (see FIG. 8) when the toner container 50 is attached to the attachment portion 40, wherein the storing portion 80 and the upper end 80A are described below.

Figure 7:
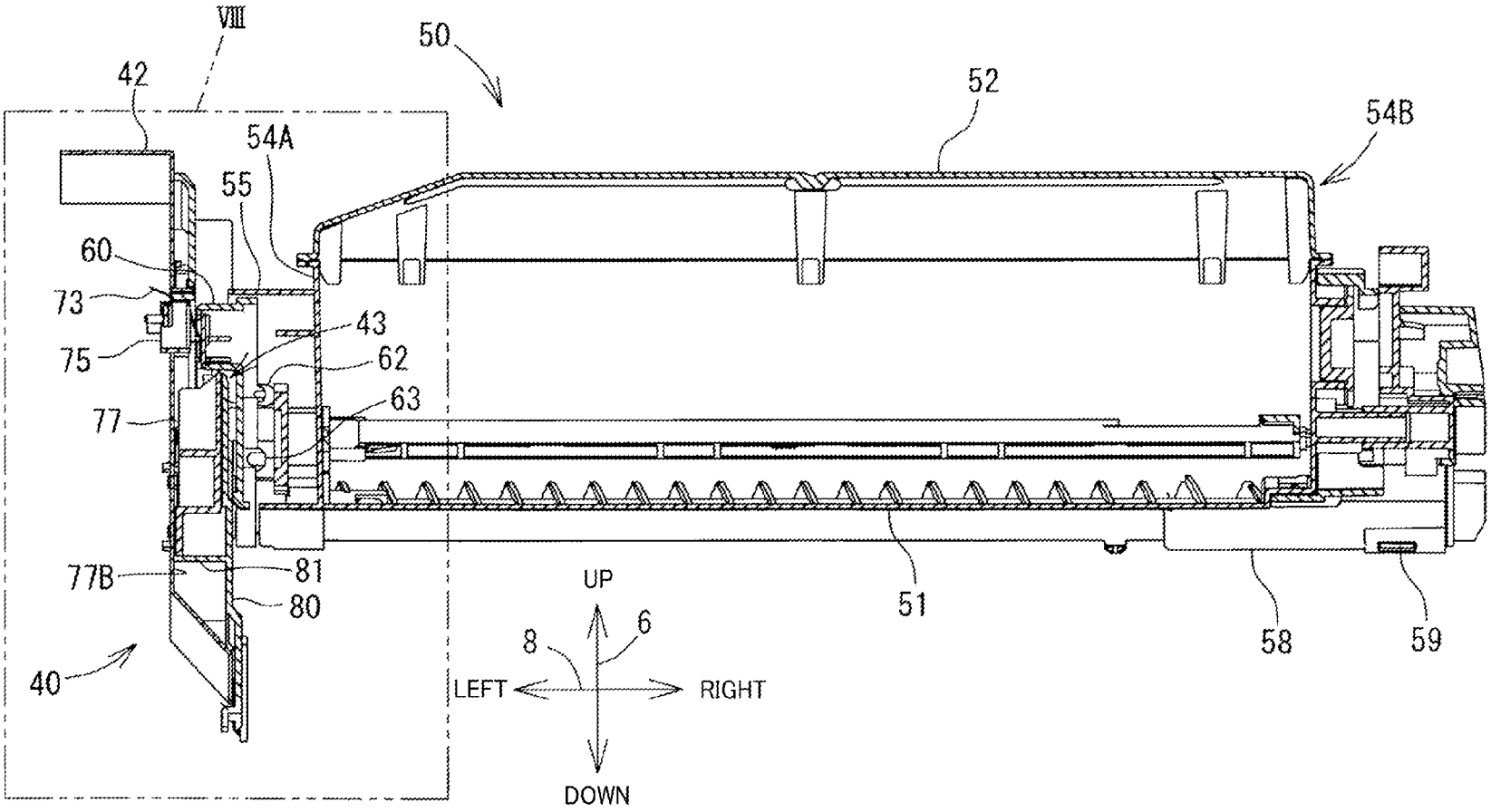
FIG. 7 is a sectional view showing the state where an end of a toner container has been attached to a mounting portion of the attachment portion.

As shown in FIG. 7, a supply port 59 is formed in a bottom 58 of the housing 51 of the toner container 50. The supply port 59 is an opening through which the toner stored in the toner container 50 is supplied to the developing device 12. The supply port 59 is provided with a shutter member (not shown). When the shutter member is slided in an opening direction in the state where the toner container 50 has been attached to a predetermined attachment position of the attachment portion 40, the supply port 59 is opened. As shown in FIG. 7, the supply port 59 is provided in the bottom 58 at the side surface 54B side of the housing 51, wherein the side surface 54B is opposite to the side surface 54A.

Meanwhile, in the toner container 50, the positional relationship between the supply port 59 and a toner receiving inlet (not shown) of the developing device 12 is important, and if the supply port 59 and the toner receiving inlet are positionally shifted from each other, a toner leakage or the like occurs. For this reason, it is configured such that an end of the toner container 50 on the side surface 54B side is positioned with respect to the attachment portion 40 to position the supply port 59 and the toner receiving inlet with a high accuracy in the state where the toner container 50 has been attached to the attachment portion 40. It is noted that, at an end on the side surface 54A side opposite to the side surface 54B, size tolerances of the housing 51 and the memory holder 60 of the toner container 50 and the like are accumulated. Thus, the end on the side surface 54A side may not necessarily be positioned to a constant position in the left-right direction 8 (the longitudinal direction of the toner container 50) of the image forming apparatus 10. In addition, the parts may expand or shrink depending on the environment (humidity, temperature, etc.) in which the image forming apparatus 10 is installed, and the housing 51 and the memory holder 60 of the toner container 50 may vary in size. In that case too, the toner container 50 may not necessarily be positioned to a constant position. In other words, the end on the side surface 54A side of a toner container 50 may not be positioned to the same position as those of the other toner containers 50. In that case, a contact failure may occur because the connection terminals 65 may fail to contact the connection terminals 73 (see FIG. 6A) of the attachment portion 40 due to the positional shift on the side surface 54A side due to the size tolerances, or because they may have an insufficient contact pressure even when they contact with each other. On the other hand, according to the present embodiment, all toner containers 50 are configured such that the memory holder 60 is positioned to a constant position and a contact failure of the connection terminals 65 hardly occurs.

[Configuration of Attachment Portion 40]

The following describes the configuration of the attachment portion 40. As shown in FIGS. 2A and 2B, the attachment portion 40 has four housing spaces 41. Four toner containers 50 are respectively held in the four housing spaces 41. The housing spaces 41 are configured to store the toner containers 50 such that the longitudinal direction D1 of the toner containers 50 matches the left-right direction 8 of the image forming apparatus 10. At the left end of the attachment portion 40, a support plate 42 is erected to support one end of each of the four toner containers 50. The support plate 42 extends in the front-rear direction 7 and faces the side surfaces 54A of the four toner containers 50. The support plate 42 supports the ends of the toner containers 50 on the side surface 54A side. More specifically, the ends of the toner containers 50 on the side surface 54A side are respectively supported by four mounting portions 43 provided on the support plate 42. It is noted that a support plate (not shown) is also erected at the right end of the attachment portion 40 to face the support plate 42, and to support the other end of each of the toner containers 50 (ends on the side surface 54B side).

Figure 6B:
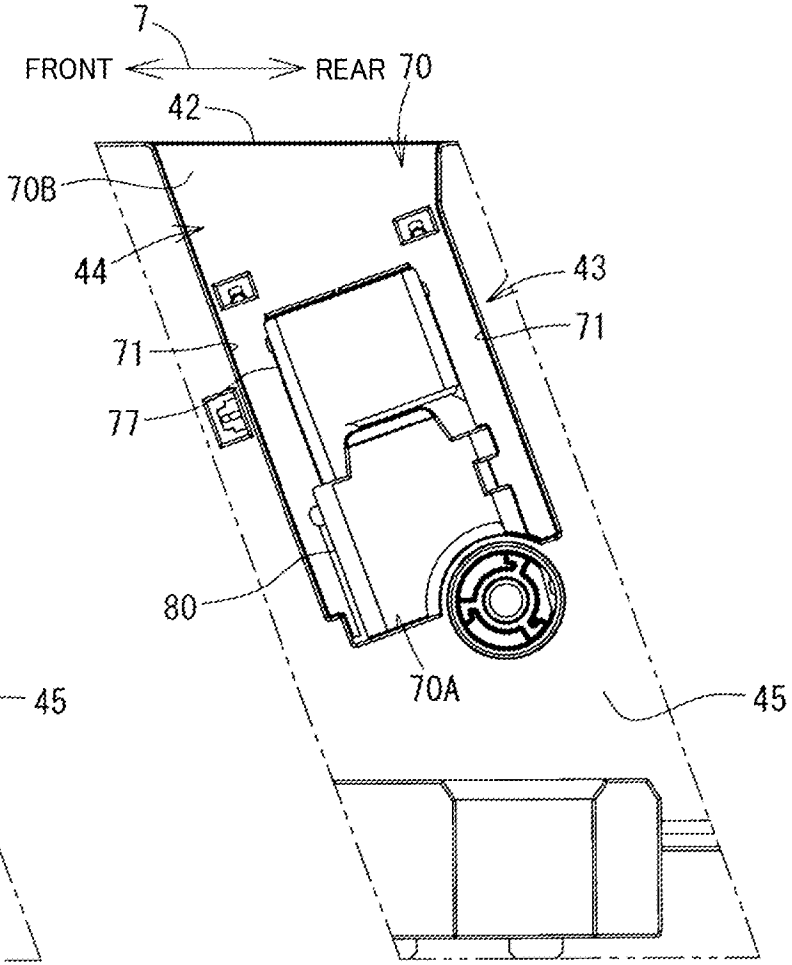
FIGS. 6A and 6B are expanded views showing details of the attachment portion.
Figure 6A:
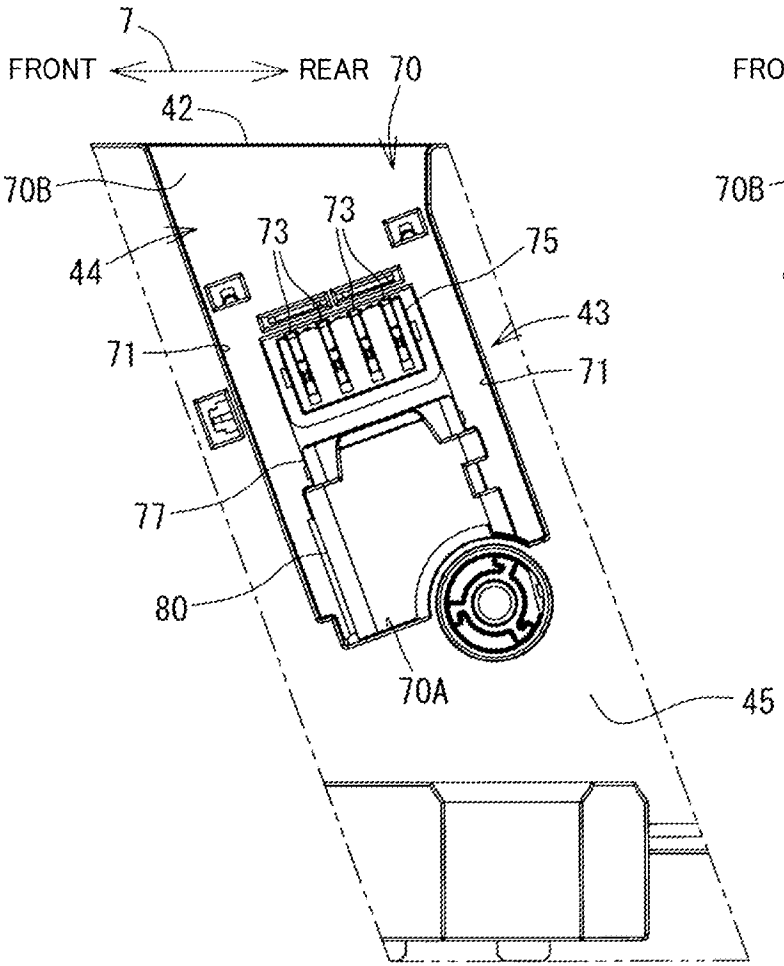

As shown in FIGS. 6A and 6B, each mounting portion 43 includes a guide groove 70 having a pair of guide surfaces 71 at opposite ends thereof in the front-rear direction 7. The guide surfaces 71 of the guide groove 70 extend diagonally upward from a bottom 70A of the guide groove 70, and are flat surfaces parallel to each other. A part between the guide surfaces 71 is a recessed part 44 where an inner side surface 45 of the support plate 42 is recessed in the thickness direction, and a front inner surface and a rear inner surface of the recessed part 44 are the guide surfaces 71. In other words, the guide groove 70 is formed on the inner side surface 45 of the support plate 42 by forming, on the inner side surface 45, the recessed part 44 whose upper part is opened.

As shown in FIG. 6A, each attachment portion 40 includes four connection terminals 73. The four connection terminals 73 are provided on a side wall 70B of each guide groove 70 that is parallel to the support plate 42. The four connection terminals 73 are respectively contacted and electrically conductively connected with the four connection terminals 65 formed on the toner container 50, wherein the four connection terminals 73 are an example of the second contact portion of the present disclosure. The four connection terminals 73 respectively correspond to the four connection terminals 65, and are disposed at positions to face the connection terminals 65 in the state where the corresponding toner container 50 has been attached to the attachment portion 40. Each of the connection terminals 73 is formed by bending and deforming a conductive metal wire or a conductive elongated plate member with a narrow width. With such a configuration, the connection terminals 73 have springness. That is, the connection terminals 73 are formed in a shape which allows them to be elastically deformed upon receiving a pressing force. An end of each connection terminal 73 is fixed to a connection board 75 that is attached to the side wall 70B. The other end of each connection terminal 73 includes a contact part 73A (see FIG. 8) that is projecting from the connection board 75 and formed in a bent shape. The contact parts 73A are respectively contacted with the connection terminals 65. It is noted that a wire harness is connected to the connection board 75, and ends of the fixed side of the connection terminals 73 are electrically connected with the wire harness.

It is noted that even when the connection terminals 73 are members having springness, the connection terminals 73 and the connection terminals 65 may not necessarily be contacted with each other appropriately by the spring force (biasing force). When the positional shifts of the toner containers 50 vary from each other, the biasing forces of the connection terminal 73 against the connection terminals 65 vary as well. In that case, the connection terminals 73 and the connection terminals 65 of the toner containers 50 cannot be contacted with each other by a constant spring force. As a result, even when the connection terminals 73 and the connection terminals 65 are contacted with each other, if the conduction becomes difficult in any connection terminals 73 or connection terminals 65 due to aged deterioration or frictional contact, a contact failure may occur due to variation in biasing force of the connection terminals 73.

The side wall 70B of each guide groove 70 is provided with a cover 77 (an example of the support portion of the present disclosure) for covering the four connection terminals 73. During an attachment operation in which a corresponding toner container 50 is attached to the attachment portion 40, the cover 77 is engaged with the toner container 50 and allows the connection terminals 65 of the toner container 50 to be moved to a predetermined set position. The set position is a position where the connection terminals 65 of the toner container 50 are in contact with the connection terminals 73 of the attachment portion 40. Specifically, the set position is a position where the connection terminals 73 are bent toward the connection board 75 side after abutting on the connection terminals 65 and further being pressed by the connection terminals 65.

The cover 77 is slidably supported by the side wall 70B. Specifically, the cover 77 is movable between a covering position (the position shown in FIG. 6B: an example of the first position of the present disclosure) covering the connection terminals 73 and an exposing position (the position shown in FIG. 6A: an example of the second position of the present disclosure) exposing the connection terminals 73. As the slide support mechanism of the cover 77, a known rail support mechanism using rails and rail guides may be adopted. When the toner container 50 has not been attached, it is possible to position the cover 77 at the covering position to protect the connection terminals 73. It is noted that the user manually moves the cover 77 to the covering position after detaching the toner container 50. Of course, an elastic member such as a spring that biases the cover 77 toward the covering position may be provided such that, when the toner container 50 is detached, the cover 77 is automatically moved from the exposing position to the covering position by the spring force that is restricted until the toner container 50 is detached. In that case, during the attachment operation in which the toner container 50 is attached to the attachment portion 40, the cover 77 is moved, resisting the spring force, from the covering position to the exposing position.

Figure 8:
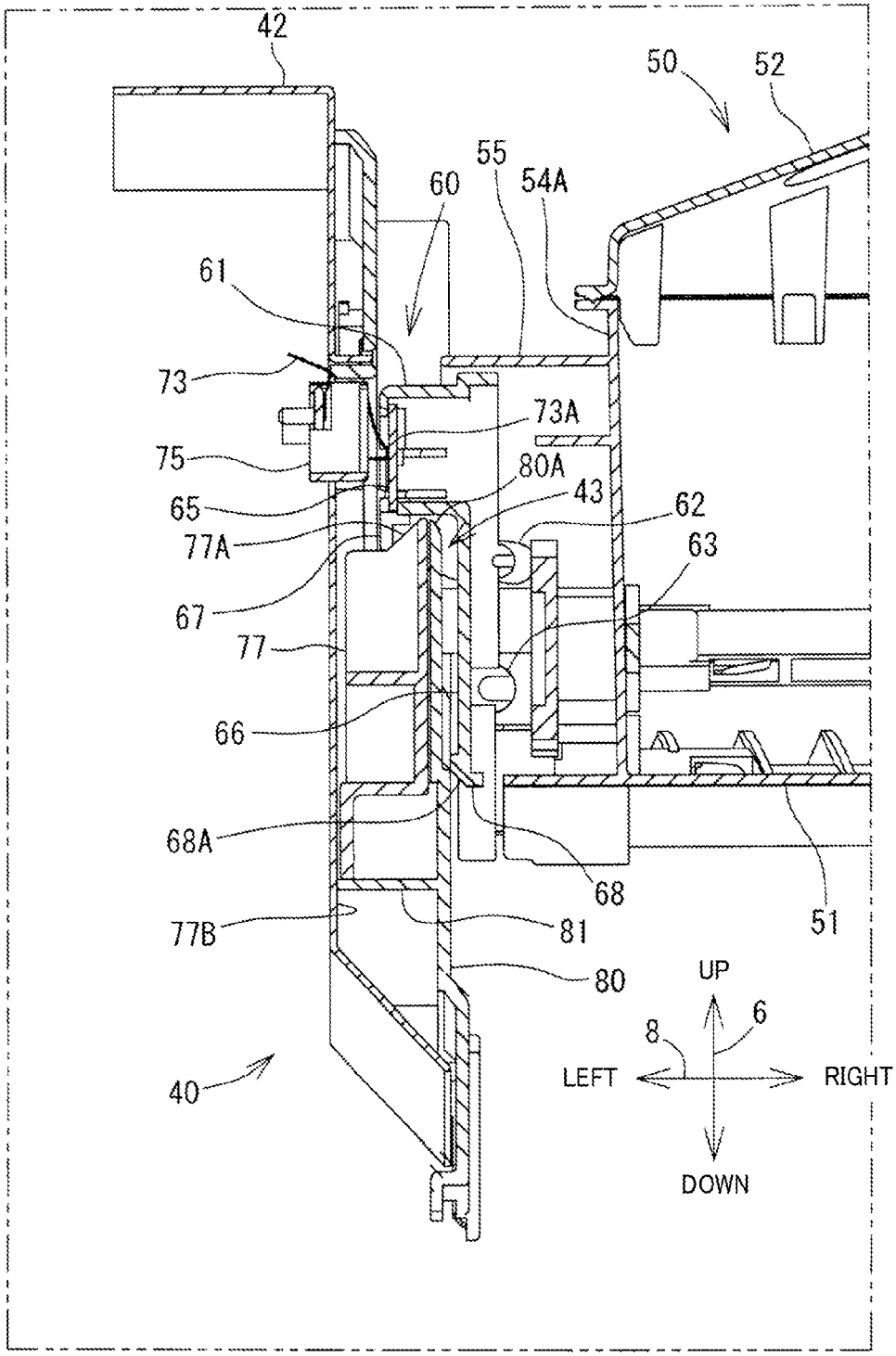
FIG. 8 is an expanded view showing the configuration of a main part VIII shown in FIG. 7.

The guide groove 70 includes a storing portion 80 configured to store the cover 77 when the cover 77 is at the exposing position. The storing portion 80 is fixed to the side wall 70B. FIGS. 7 and 8 shows the attachment state where the toner container 50 has been attached to the attachment portion 40.

As shown in FIGS. 7 and 8, the storing portion 80 is located farther away from the side wall 70B than the cover 77. When the cover 77 moves to the exposing position, the cover 77 is stored in a storing space formed between the side wall 70B and the storing portion 80. Inside the storing portion 80, a stopper 81 is formed to restrict the movement of the cover 77. The stopper 81 is a plate-like member that extends vertically from the rear surface of the storing portion 80 toward the side wall 70B, and supports the lower end of the cover 77. Specifically, when the cover 77 is pulled down to the exposing position, the lower end of the cover 77 abuts on the stopper 81 and is restricted from moving downward from the position.

In the present embodiment, as shown in FIG. 8, the upper end 80A of the storing portion 80 is positioned such that, during the operation of attaching the toner container 50 to the attachment portion 40, the inclined surface 68A of the memory holder 60 abuts on the upper end 80A. That is, the storing portion 80 is formed in a size and at a position which enable the upper end 80A to abut on the inclined surface 68A during the attachment operation.

In addition, as shown in FIG. 8, the inclined surface 77A (an example of the pressed portion and the inclined portion of the present disclosure) is formed at the upper end of the cover 77. The inclined surface 77A is inclined downward from the upper end of an outer wall 77B of the cover 77 toward the inside of the cover 77. The inclined surface 77A is engaged with the engagement pieces 67 of the memory holder 60. FIG. 8 shows a state where the cover 77 is positioned at the exposing position and the engagement pieces 67 are engaged with the inclined surface 77A. In the present embodiment, during the attachment operation in which the toner container 50 is attached to the attachment portion 40, when the toner container 50 is inserted in the attachment direction, the engagement pieces 67 abut on the inclined surface 77A and the cover 77 receives a pressing force in the attachment direction. This allows the cover 77 to move from the covering position to the exposing position. When the cover 77 reaches the exposing position, the memory holder 60 is pulled out from the protruding portion 55 by the pressing force in the attachment direction, and the connection terminals 65 are pulled toward the connection terminals 73. That is, by being engaged with the engagement pieces 67, the inclined surface 77A provides the memory holder 60 with a force that pulls the connection terminals 65 toward the connection terminals 73 during the attachment operation in which the toner container 50 is attached.

Figures 9A, 9B, 9C, 9D, 9E:
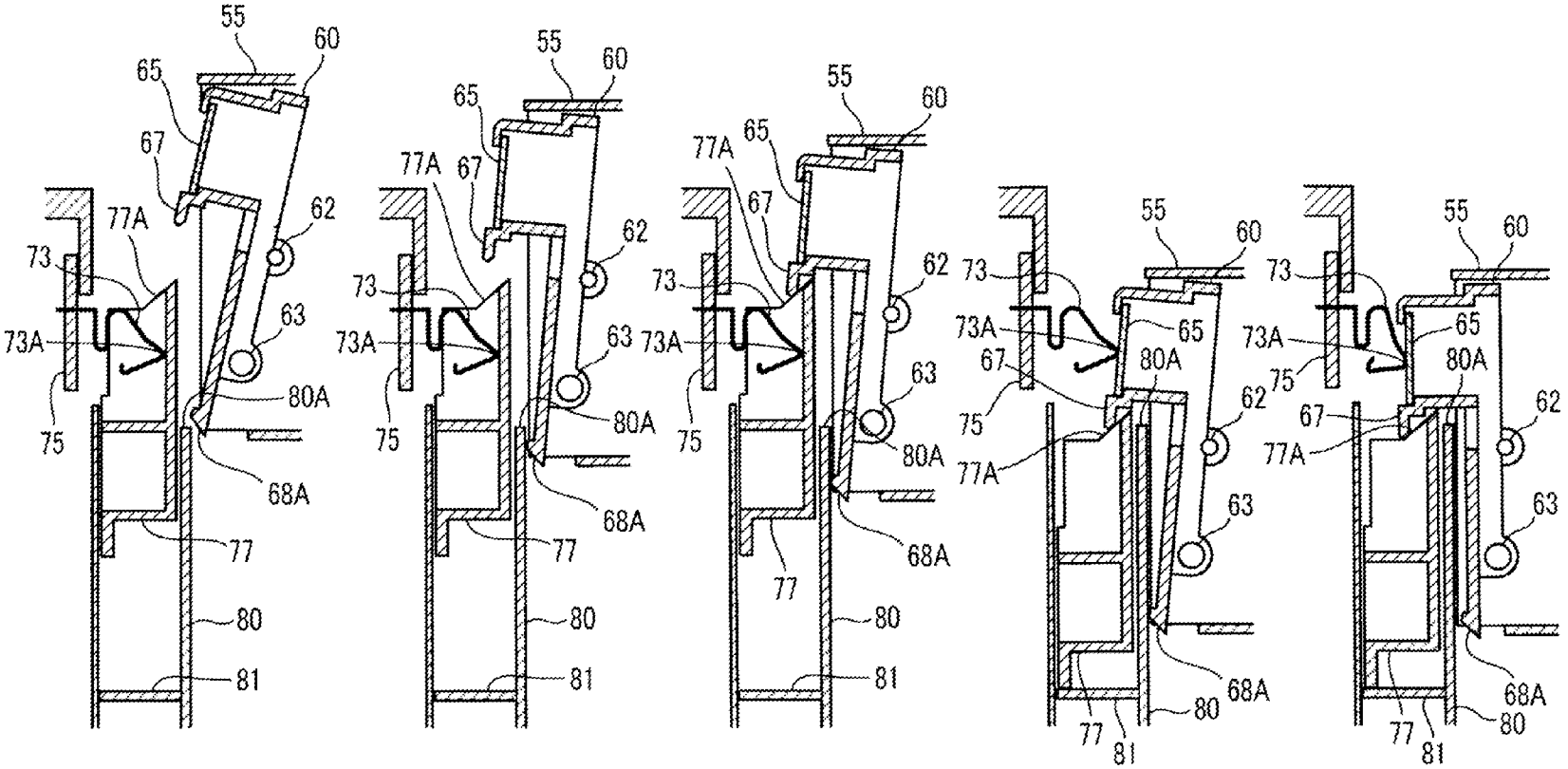
FIGS. 9A through 9E are diagrams showing an attachment operation in which the memory holder of the toner container is attached to the mounting portion of the attachment portion.

The following describes, with reference to FIGS. 9A-9E, a memory holder attachment operation in which, during an attachment of a toner container 50, the memory holder 60 on the side surface 54A side of the toner container 50 is attached to the mounting portion 43. Here, FIG. 9A shows a state where the cover 77 is positioned at the covering position and the memory holder 60 has not been attached. In this state, the memory holder 60 is in the first attitude where the holder main body 61 is partially retracted into the protruding portion 55 and the memory holder 60 is closest to the side surface 54A. When the toner container 50 is further inserted in the attachment direction (downward in FIGS. 9A-9E), first the inclined surface 68A of the memory holder 60 abuts on the upper end 80A of the storing portion 80 (see FIG. 9B). At this time, the inclined surface 68A receives a force in a direction to separate from the upper end 80A (rightward in FIGS. 9A-9E). This force acts in such a manner that the memory holder 60 is rotationally moved around the pivoting shafts 63 positioned above the inclined surface 68A toward the second attitude. As a result, as shown in FIG. 9B, the connection terminals 65 of the memory holder 60 are pulled toward the connection terminals 73 side.

When the toner container 50 is further inserted in the attachment direction, the engagement pieces 67 abut on and are engaged with the inclined surface 77A of the cover 77 (see FIG. 9C). At this time, the inclined surface 77A receives a pressing force (downward force) from the engagement pieces 67. As described above, the cover 77 has been positioned at the closing position. As a result, upon receiving the downward force, the cover 77 is moved to the exposing position. When the cover 77 is moved to the exposing position, the lower end of the cover 77 is supported by the stopper 81 (see FIG. 9D).

When the toner container 50 is further inserted in the attachment direction while the cover 77 is positioned at the exposing position, the inclined surface 77A converts the pressing force in the attachment direction (downward force) from the engagement pieces 67, into a horizontal force, allowing the holder main body 61 to be pulled toward the mounting portion 43 side. That is, the memory holder 60 is rotationally moved around the pivoting shafts 63 from the first attitude toward the second attitude. This allows the connection terminals 65 to abut on contact portions 73A of the connection terminals 73 (see FIG. 9D). Subsequently, when the toner container 50 is further inserted in the attachment direction and the memory holder 60 is rotationally moved to the second attitude, the connection terminals 65 press and compress the connection terminals 73 (see FIG. 9E). In addition, when the memory holder 60 is rotationally moved to the second attitude, the engagement pieces 67 slide down the inclined surface 77A to reach a flat part of the upper end of the cover 77. Here, the engagement between the inclined surface 77A and the engagement pieces 67 maintains the memory holder 60 in the second attitude. When the memory holder 60 is in the second attitude in this way, the connection terminals 65 receive an elastic force from the connection terminals 73 in response to the compression of the connection terminals 73, thereby allowing the connection terminals 65 and the connection terminals 73 to be in contact with each other. It is noted that the position of the connection terminals 65 when the memory holder 60 is positioned at the second attitude corresponds to the set position of the present disclosure.

In the image forming apparatus 10 of the above-described embodiment, when the toner container 50 is attached to the attachment portion 40, the memory holder 60 is pulled from the protruding portion 55 and is fixed to a constant position, namely the second attitude. As a result, the connection terminals 65 provided on the memory holder 60 are also fixed to a constant position. This enables the connection terminals 65 of the toner container 50 to be electrically contacted with the connection terminals 73 stably in a reliable manner even if the toner container 50 has a size tolerance in the longitudinal direction. In addition, the memory holder 60 is configured to be pulled out from the protruding portion 55 by a pressing force that is generated during the attachment of the toner container 50. This makes it possible to reduce the cost and simplify the configuration, compared to a configuration in which a driving force of a motor or the like is used.

The above-described embodiment discloses, as an example, a configuration where the memory holder 60 can be dislocated freely between the first attitude and the second attitude when the toner container 50 has not been attached. However, the present disclosure is not limited to this configuration. For example, an elastic member such as a spring that biases the memory holder 60 toward the first attitude side may be used to maintain the memory holder 60 in the first attitude even under the condition where no external force is applied, wherein in the first attitude, the memory holder 60 is close to the side surface 54A.

The above-described embodiment discloses, as an example, a configuration where the memory holder 60 is configured to be rotationally moved. However, not limited to this configuration, the following configuration is applicable, for example. That is, in the configuration, the memory holder 60 is slidable in a direction vertical to the side surface 54A while being kept to be parallel to the side surface 54A.

The above-described embodiment discloses, as an example, a configuration where the memory holder 60 is pulled out from the protruding portion 55. However, the following configuration may be applied instead. That is, in the configuration, the memory holder 60 is not provided, the connection terminals 65 are provided on the side surface 54A of the toner container 50, and an engaged portion that is engaged with the inclined surface 77A is provided on the side surface 54A such that the toner container 50 itself is pulled close.

The above-described embodiment discloses, as an example, a configuration where the cover 77 is movable. However, the cover 77 is an example of the support portion of the present disclosure, and may not necessarily be configured to be movable. The cover 77 only needs to be fixed to the side wall 70B at the exposing position. Of course, in that case, the storing portion 80 does not need to be provided.

The above-described embodiment discloses, as an example, the toner container 50 as the replacement member. However, the present disclosure is not limited to the toner container 50, but is applicable to any replacement member as far as it is replaceable with respect to the image forming apparatus 10. For example, the present disclosure is applicable to an option unit (a FAX unit, a both-side printing unit, a scanner unit, etc.) that is attachable/detachable with respect to the image forming apparatus 10. In addition, the present disclosure is applicable to a waste toner bottle for collecting waste toner that was not used in the developing. Furthermore, when the sheet feed device 25 or the fixing device 26 is configured to be attachable/detachable, the present disclosure is applicable to the attachment and detachment of such devices.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

an attachment portion which is provided in an apparatus main body and in which support plates are disposed to face each other; and a replacement member which is supported between the support plates of the attachment portion in an attachable/detachable manner, the replacement member including a first contact portion which is provided on a side surface that faces one of the support plates and is electrically conductive when contacted with the one of the support plates, the attachment portion including:

a second contact portion which is provided on the one of the support plates and is electrically connected with the first contact portion upon contact therewith; and a support portion which, during an attachment operation in which the replacement member is attached to the attachment portion, is engaged with the replacement member and allows the first contact portion to be moved to a predetermined set position at which the first contact portion is in contact with the second contact portion, wherein the replacement member includes a holding portion which is attached to the side surface of the replacement member and holds the first contact portion, the holding portion includes a pressing portion which, during the attachment operation, presses a pressed portion provided on the support portion, and the pressed portion of the support portion includes an inclined portion which, during the attachment operation, guides the holding portion toward the set position by allowing the pressing portion to move while abutting on the inclined portion.

2. The image forming apparatus according to claim 1, wherein the holding portion is supported to be movable toward and away from the side surface of the replacement member, and during the attachment operation, the support portion of the attachment portion moves the first contact portion to the set position by allowing the holding portion to move away from the side surface of the replacement member.

3. The image forming apparatus according to claim 2, wherein the holding portion includes an arm that extends downward, and the holding portion is supported so as to be rotationally moved around a pivoting shaft in such a way as to be moved toward and away from the side surface, the pivoting shaft being provided at an end of the arm.

4. The image forming apparatus according to claim 3 further comprising an elastic member which biases the holding member in a direction in which the holding portion is moved away from the side surface.

5. The image forming apparatus according to claim 1, wherein the replacement member is a toner container which is configured to store toner and in which a supply port is formed, the toner being supplied to outside through the supply port, and the first contact portion is a connection terminal of a storage portion storing information related to the toner stored in the toner container.

6. The image forming apparatus according to claim 5, wherein the supply port is provided in a vicinity of the other side surface of the replacement member, the other side surface being opposite to the side surface.

7. An image forming apparatus comprising:

an attachment portion which is provided in an apparatus main body and in which support plates are disposed to face each other; and a replacement member which is supported between the support plates of the attachment portion in an attachable/detachable manner, the replacement member including a first contact portion which is provided on a side surface that faces one of the support plates and is electrically conductive when contacted with the one of the support plates, the attachment portion including:

a second contact portion which is provided on the one of the support plates and is electrically connected with the first contact portion upon contact therewith; and a support portion which, during an attachment operation in which the replacement member is attached to the attachment portion, is engaged with the replacement member and allows the first contact portion to be moved to a predetermined set position at which the first contact portion is in contact with the second contact portion, wherein the support portion is supported to be movable in a direction between a first position to cover the second contact portion and a second position to expose the second contact portion, and during the attachment operation, the support portion is moved from the first position to the second position upon receiving, from the replacement member, a force in a direction in which the replacement member is attached to the support portion, and at the second position, allows the first contact portion to be moved to the set position.

8. The image forming apparatus according to claim 7 further comprising:

an elastic member which biases the support portion toward the first position, and when the replacement member is attached to the attachment portion, the support portion is moved from the first position to the second position while resisting a biasing force of the elastic member, and when the replacement member is detached from the attachment portion, the support portion is moved from the second position to the first position by the biasing force.

* * * * *